US005241146A

United States Patent [19]

Priesemuth

[11] Patent Number: 5,241,146

[45] Date of Patent: Aug. 31, 1993

[54] CONTACT-TYPE SWITCH

[76] Inventor: Wolfgang Priesemuth, Postkamp 13, 2210 Breitenburg-Nordoe, Fed. Rep. of Germany

[21] Appl. No.: 635,766

[22] Filed: Dec. 28, 1990

[30] Foreign Application Priority Data

Dec. 28, 1989 [DE] Fed. Rep. of Germany ..... 3943434

[51] Int. Cl.[5] ..... H01H 13/12

[52] U.S. Cl. ..... 200/531; 200/345

[58] Field of Search ..... 200/530, 531, 253, 345, 200/341, 342, 520, 536, 517, 528

[56] References Cited

U.S. PATENT DOCUMENTS

| | | | |
|---|---|---|---|
| 3,104,300 | 9/1963 | Hutt | 200/530 |
| 3,818,169 | 6/1974 | Kobernus | 200/531 |
| 4,650,945 | 3/1987 | Smock et al. | 200/531 X |
| 4,704,503 | 11/1987 | Takasawa | 200/531 X |
| 4,800,245 | 1/1989 | Murmann et al. | 200/517 X |
| 4,939,327 | 7/1990 | Wu et al. | 200/517 |
| 5,178,265 | 1/1993 | Sepke | 200/528 |

FOREIGN PATENT DOCUMENTS

| | | | |
|---|---|---|---|
| 2737221 | 2/1979 | Fed. Rep. of Germany | 200/534 |
| 3629650 | 3/1990 | Fed. Rep. of Germany . | |

*Primary Examiner*—Henry J. Recla
*Assistant Examiner*—Glenn T. Barrett
*Attorney, Agent, or Firm*—Robert W. Becker & Associates

[57] ABSTRACT

A contact-type switch is provided that includes a housing and, disposed in the housing, a plunger having a long-stroke configuration. Essentially immediately after a shifting out of an outer end position and in a direction that is essentially in the direction of a central axis of the housing, the plunger breaks at least one switch contact that is disposed in the housing. A specific displacement path or dead travel is carried out by the plunger between its outer end position and the position where the switch contact is broken. Both the plunger and a region of the housing where the plunger enters the same have an essentially at least five-sided cross-sectional configuration, with this entry region forming a first guide for the plunger.

16 Claims, 2 Drawing Sheets

CONTACT-TYPE SWITCH

BACKGROUND OF THE INVENTION

The present invention relates to a contact-type switch that includes a housing and, disposed in the housing, a plunger or push member having a long-stroke configuration, whereby essentially immediately after a shifting out of an outer end position and in a direction that is essentially in the direction of a central axis of the housing, the plunger breaks or opens at least one switch contact that is disposed in the housing, and whereby a specific displacement path or dead travel is carried out by the plunger between the outer end position thereof and the point or position where the switch contact is broken.

A contact-type switch of this general type is known (DE-OS 36 29 650). Contact-type switches of this type are used particularly in the automobile industry and are frequently used as switches for closing a circuit, for example when vehicle doors are opened and as a consequence thereof lights within the passenger space of the vehicle are switched on. As a result of the door constructions that are generally utilized in the modern motor vehicle industry, it is necessary that switches of this type for these purposes carry out considerable switch strokes or travel. Switch-extending constructions to solve such problems are not suitable, since in contact-type switches the stroke or travel of the switch plunger must be determined by the construction of the switch itself, and plunger-extending measures thus offer no solution to this problem.

With the heretofore known contact-type switches, which are installed in a large number of motor vehicles that are available on the market these days, and which switches also basically showed very good switching characteristics in operation, it was found that under conditions of extreme atmospheric moisture in the region where the contact-type switch was disposed on the vehicle door, disruptions in operation could not be completely precluded. The basis for these disruptions in operation is that the plastic that is used for the individual structural elements of the switch, and that is provided with its final shape via an injection molding process, exhibits the tendency to occlude water in a molecular manner in the surface layer of the plastic, resulting, for example, in a radial expansion of the diameter of the switch plunger of the known contact-type switch; this suffices to allow the plunger to become wedged or seized in the switch in its guide or mounting means, which are made of the same material. Although this shortcoming was attempted to be eliminated by enlarging the opening of the entry region of the switch plunger into the housing, so that as a result radial increases in the cross-sectional area no longer resulted in the aforementioned drawbacks, none the less the result of this measure was that since a satisfactory guidance of the switch plunger in the housing could then no longer be ensured, shortcomings relative to the switching reliability occurred that under all circumstances had to be avoided, so that this course for eliminating the original shortcoming could not be taken.

It is therefore an object of the present invention to provide a contact-type switch that on the one hand is an economical, mass produced product that can be installed in motor vehicles and can carry out its switching functions in a reliable manner over a long operational time span, and that on the other hand can continuously carry out its switching functions as designed even under extreme conditions of atmospheric moisture.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
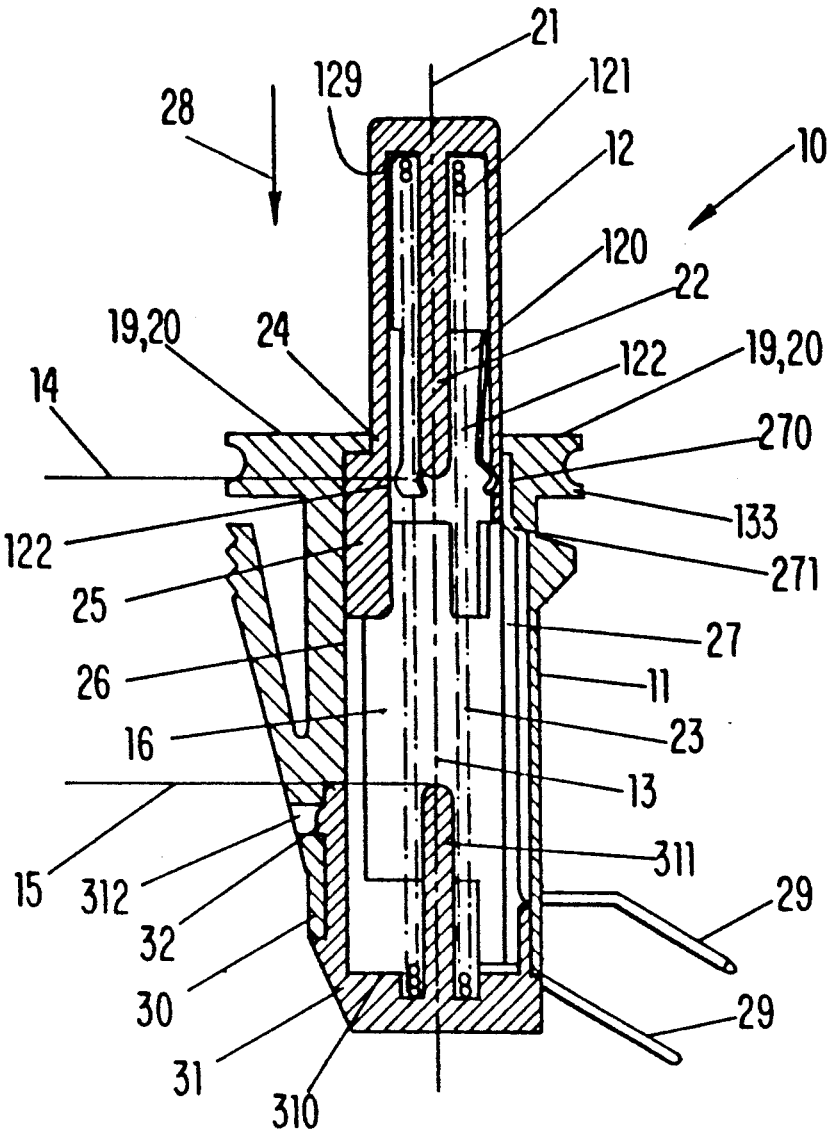
FIG. 1 is an enlarged cross-sectional view of one exemplary embodiment of the inventive contact-type switch, with the switch plunger being disposed in its outer end position.

The contact-type switch of the present invention is characterized primarily in that both the switch plunger and a region of the housing where the plunger enters the same have an essentially at least five-sided cross-sectional configuration, with the entry region forming a first guide means for the plunger.

The advantage of the inventive contact-type switch consists essentially in that by providing the at least five-sided cross-sectional configuration of the switch plunger and of the correspondingly formed guide means in the entry region for the plunger into the switch, a possible radial displacement of the plunger within still acceptable tolerances cannot lead to wedging of the plunger in the entry region, which at that location forms a first guide means, even if as a result of extreme atmospheric moisture conditions water occludes in a molecular manner in the surface layer of the plastic that forms the plunger. Thus, this configuration of the entry region makes it possible to make the entry opening large enough that even a plunger that has expanded radially to the maximum extent will not seize or become wedged in the correspondingly shaped guide means of the entry region of the switch housing.

Pursuant to one advantageous specific embodiment of the inventive contact-type switch, the switch plunger is essentially hollow, with the interior thereof being provided with a switch contact mechanism that is embodied in the form of an insert that can be disposed in this interior. As a result, a very important component of the contact-type switch, namely the switch contact mechanism, can be disposed in a casing that is open on only one side and that is formed by the switch plunger. Consequently, a greatly increased degree of contact reliability is achieved even where moisture penetrates into the interior of the switch, a condition that can never be entirely prevented.

The switch contact arrangement preferably includes at least one arm-like switch contact that extends essentially in the direction of the axis of the housing. With, for example, a hexagonal cross-sectional configuration of the switch contact arrangement, three arm-like switch contacts are preferably provided, whereby one of these switch contacts serves, for example, for the ground contact, and the other two switch contacts, or at least one of the remaining switch contacts, is the switch-engaging contact that in the activated state communicates with a consuming device or other load. Where the switch contact mechanism has three arms, and a hexagonal cross-sectional configuration is provided, the switch contacts additionally stabilize the switch plunger as it moves into the housing of the switch relative to its orientation in the direction of the axis of the housing.

The switch contact mechanism advantageously has a flat base portion and at least one of the aforementioned arms, which projects at essentially right angles from the base portion, and an extension of the free end of which is in the form of the switch contact. In this way, the entire switch contact mechanism, including all of the switch contacts, can advantageously be made as an integral piece in a single manufacturing process, which has a very favorable impact upon the ability to be able to manufacture all of the components in an economical manner, which especially in the motor vehicle industry is critical. The switch contact mechanism itself can also advantageously have an essentially at least five or six-sided configuration, with a hexagonal cross-sectional configuration having proven to be particularly advantageous.

Pursuant to a further advantageous specific embodiment of the inventive contact-type switch, the side wall of the switch plunger is provided with radial openings, the number of which corresponds to the number of switch contacts; the ends or noses of the switch contacts can extend through these radial openings. As mentioned above, the hollow switch plunger also provides an additional good protection against the penetration or entry of moisture to the individual switch contacts to the greatest extent possible. However, it is also necessary to keep the immediate region of the noses of the switch contacts free of housing elements of the plunger so that the switch contacts can cooperate with appropriate counter contacts. At the same time, in order to keep this region that must be kept free as small as possible, with the embodiment being described openings are provided in the wall of the plunger, which makes it possible to otherwise extend the plunger beyond this region, thereby again increasing the switching reliability.

Advantageously projecting from the base of the interior of the switch plunger is an axial projection that essentially extends along the axis of the plunger, with this projection being provided for receiving and guiding a compression spring that ensures that the plunger is always urged into an outer end position if no counteracting force is present. By means of this projection, the compression spring is very well concentrically held and oriented relative to the axis of the switch plunger without any additional measures having to be taken.

That end of the plunger that is disposed in the housing is preferably provided with a second, wider guide means or element that is in sliding engagement with the interior wall of the housing, which is embodied at least partially as a guide. In this connection, it is advantageous to embody the inner space of the housing either with an essentially rectangular cross-sectional configuration or also with a five-sided or other multi-sided cross-sectional configuration in conformity with the cross-sectional configuration of the switch plunger. As a result, during operation any torque of the switch plunger that occurs radially relative to the axis of the plunger, and that in any case is significant, is precluded.

At least one contact strip is disposed in the inner space of the housing and extends essentially parallel to the axis of the housing; this contact strip cooperates with the switch contact provided in the plunger. The number of contact strips within the housing of the switch corresponds to the number of switch contacts of the switch contact mechanism.

In this connection, it is very advantageous for the contact strip to have an active region in conformity with the length of the selected displacement path (dead travel), and immediately adjacent thereto, in the direction of displacement of the switch plunger into the housing, to provide an offset region that extends at an angle radially outwardly relative to the axis of the housing. As a consequence of this configuration of the contact strip, it is possible in a very simple manner to structurally fix the specific displacement path and in so doing at the same time to ensure that the nose of the switch contact breaks the electrical connection between the contact strip and the switch contact at a defined location during the course of pushing the plunger in. In this connection, it is also advantageous that due to the selected form of the outwardly offset region, a continuous self-cleaning of the switch contact noses occurs, so that a very high degree of switching reliability is achieved.

So that not only during assembly of the contact-type switch but also with regard to a continuously good contact, no mechanical and electrical connection problems occur between the actual contact strip and outwardly extending connections of the switch, the contact strip is integrally formed with a contact prong or plug means that leads out of the housing and has a blade or tongue-like configuration.

To facilitate assembly and to obtain the desired high reliability against moisture, that end of the housing that is remote from the entry region of the plunger is preferably closed off by a base part that is generally made of the same plastic as are the switch housing and plunger.

Pursuant to one advantageous specific embodiment of the base part, the latter is provided with a projection that projects from the inner base surface essentially parallel to the axis of the plunger; this projection serves to receive and guide the compression spring, so that with this embodiment, separate mounting and centering measures for the compression spring can be eliminated at this location.

Finally, it is advantageous to connect the base par with the housing via clip or snap means that are integrally embodied with the base part and/or with the housing. On the one hand, these clip or snap means permit an extremely rapid and hence economical assembly, and on the other hand they permit an assembly of the switch that again requires no separate mounting means and hence is similarly economical. Clip or snap means of this type have also proven to be very durable when used in motor vehicles.

Further specific features of the present invention will be described in detail subsequently.

DESCRIPTION OF PREFERRED EMBODIMENTS

Referring now to the drawings in detail, the contact-type switch 10 essentially comprises a housing 11, a plunger or push member 12, as well as a base part 31 that is provided at the end 30 of the housing 11. The housing 11 is hollow, thereby forming an inner space 16 in which the switch plunger 12 can be longitudinally shifted along the axis 13 of the housing 11. In the view illustrated in FIG. 1, the switch plunger 12 is shown in an outer end position 14; the plunger 12 can be pushed in to the inner end position 15. For the sake of simplicity, in FIG. 1 the outer end position 14 and the inner end position 15 are correlated to respective ends provided on the projection 22 of the switch plunger 12 and on the projection 311 of the base part 31. These projections 22, 311 will be described in detail subsequently.

Figure 2:
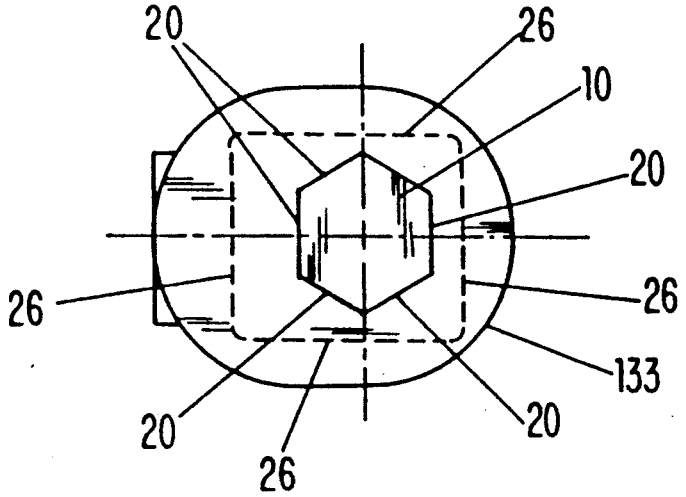
FIG. 2 is a plan view of the contact-type switch of FIG. 1.

In the illustrated embodiment, the switch plunger 12 has a hexagonal cross-sectional configuration (FIG. 2) and rests in a first guide means 20 that is formed in the housing 11 at the entry region 19 of the plunger 12 into the housing 11. That end 24 of the plunger 12 that is mounted in the housing 11 is provided with a second, wider guide means or element 25. By means of this guide element 25, the plunger 12 is in sliding engagement with the interior wall 26 of the housing 11, with this interior wall 26 acting as a guide means. As can be seen from FIG. 2, the inner space 16 of the housing, in which the second guide element 25 is guided, has an essentially rectangular cross-sectional configuration, whereby in principle the guide element 25 could also rest on all of the interior walls 26 of the housing 11, i.e. could be continuous. However, the cross-sectional configuration of the inner space 16 could also have any other desired shape, for example five-sided, six-sided, some other multi-sided configuration, or could even be circular.

Figure 3:
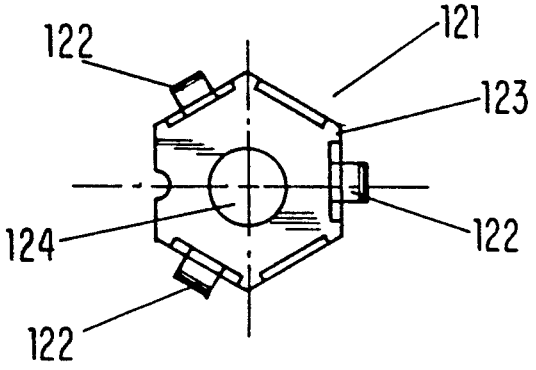
FIG. 3 is a view of a switch contact mechanism that has three switch contacts and is disposed in the switch plunger.
Figure 4:
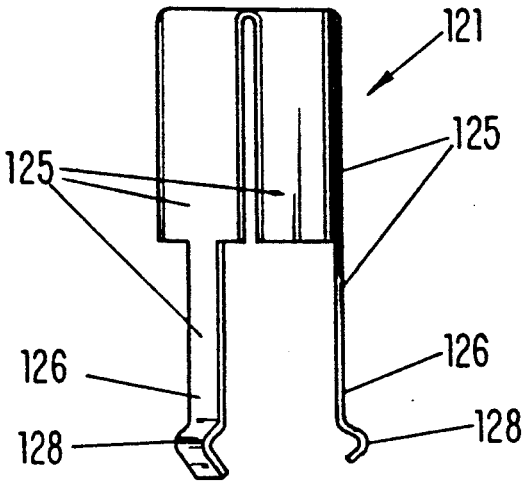
FIG. 4 is a side view of the switch contact mechanism illustrated in FIG. 3.

The switch plunger 12 is hollow, with a switch contact mechanism 121 that is in the form of an insert being disposed in the interior 120 of the plunger 12 and extending to the region of the base thereof. The switch contact mechanism 121 has three arm-like switch contacts 122, as can be seen more clearly from FIGS. 3 and 4. The switch contacts 122 extend essentially parallel to one another, i.e. in the state in which they are inserted into the interior 120, parallel to the axis 13 of the housing 11, which is also the axis 21 of the plunger 12. The switch contact mechanism 121 has a flat base portion 123, in the center of which is provided a hole 124. Arms 125 project at right angles from the base portion 123. The actual switch contacts 122 are formed at the free ends 126 of the arms 125 as extensions thereof As shown in FIG. 4, in this region the arms 125 that directly form the switch contacts 122 can be narrower. The side wall of the switch plunger 12 is provided with a plurality of radial openings 127 to allow the noses 128 of the switch contacts 122 to pass through. The number of radial openings 127 corresponds to the number of switch contacts 122 provided on the switch contact mechanism 121.

Figure 5:
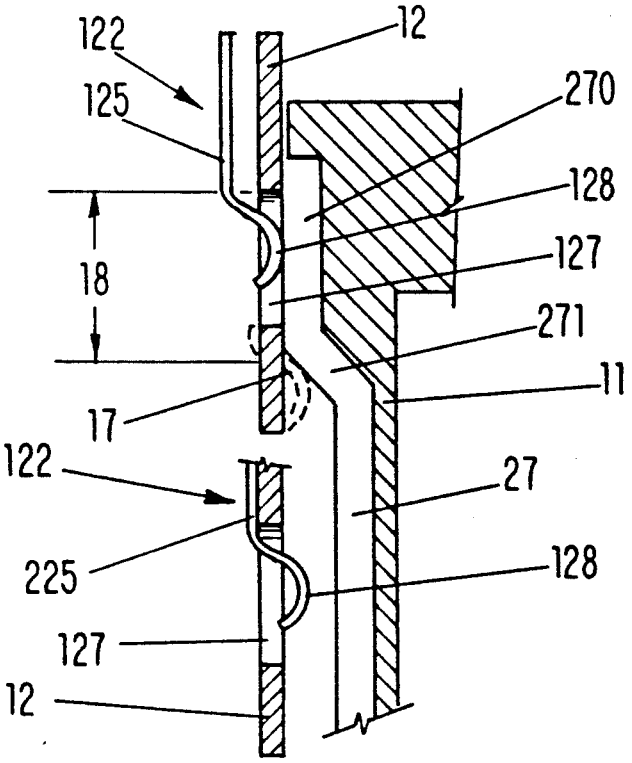
FIG. 5 is an enlarged view of a portion of the contact-type switch of FIG. 1, with two positions of a switching-engagement and non-switching state of the contact-type switch being illustrated.

Disposed on the interior walls 26 that define the inner space 16 of the housing 11 are contact strips 27, the number of which correspond to the number of switch contacts 122 that are provided; the contact strips 27 cooperate with the switch contacts 122 provided on the plunger 12. In this connection, the contact strips 27 are disposed essentially parallel to the axis 13 of the housing 11. Each contact strip 27 has an active region 270 in conformity with the length of the selected displacement path 18, which is the corresponding dead travel; in other words, in this displacement region the switch contacts 122 of the contact-type switch 10 remain in switching engagement. Immediately adjoining the displacement path 18 of the switch plunger 12 into the housing 11 is a region 271 of the contact strip 27 that, relative to the axis 13 of the housing, is offset radially at an angle toward the outside. In this radially outwardly offset region 271, as can be seen in FIG. 5, a defined switch point for the switch contacts 122 relative to the contact strips 27 is provided FIG. 5 also shows a second position of the switch contacts 122 relative to the contact strip 27 in which the non-switching position of the contact-type switch 10 is achieved, where the arm 125 of the switch contact 122 rests directly against the inner wall of the switch plunger 12 and thereby extends freely through the opening 127 in the side wall of the plunger 12. To increase contact reliability, and also to simplify manufacture and assembly, the contact strip 27 is integral with a contact plug or prong means 29 that leads to the outside of the housing 11. The outwardly offset region 271, which is disposed at an obtuse angle to the active region 270, has the additional task of cleaning the actual switch contact noses 128, since during each switching movement of the contact-type switch 10 as designed, not only does a point-type rubbing of the switch contact nose surfaces occur, but rather, due to the fact that the noses 128 have a semicircular cross-sectional configuration, a rubbing of a considerable portion of the active contact surface of the respective switch contact nose 128 occurs.

As indicated previously, that end 30 of the housing 11 that is remote from the entry region 19 for the switch plunger 12 is provided with a base part 31. This base part is connected to the housing 11 via clip or snap means 32, 312 that are integral with the base part 31 and/or with the housing 11. The aforementioned projection 311 extends inwardly from the inner base surface 310 of the base part 31 essentially in line with the axis 21 of the switch plunger 12. This projection 311 serves to receive and guide the compression spring 23, the other end of which is mounted on the axial projection 22 that extends from the base 129 of the interior 120 of the switch plunger 12, with the projection 22 also being disposed essentially in line with the axis 21 of the plunger 12.

At its upper end (with reference to FIG. 1), the contact-type switch 10 is provided with a collar-like attachment extension 133 that extends essentially perpendicular to the axis 13 of the housing 11. This attachment extension 133 also serves to receive a non-illustrated bellows-like cap of elastomeric material that provides additional protection against moisture entering the contact-type switch 10 via the entry region 19 and into the inner space 16 of the housing 11 or into the interior 120 of the switch plunger 12. When the contact-type switch 10 is operated as designed, this switch is moved in the displacement direction 28, whereby the switch plunger 12 can be shifted in the direction of the axis 13 of the housing 11 and into the inner space 16 of the housing, and in particular out of the outer end position 14 into an inner end position 15. In so doing, the switch contacts 122 are in engagement with the associated contact strips 27 until the switch contact 122 has passed through the specific displacement path 18 in conformity with a predetermined length of the active region 270 of the contact strip 27. This displacement path 18 is determined in a designated manner during manufacture. If the maximum displacement path 18 is exceeded during the course of the movement of the switch plunger 12 in a direction toward the inner end position 15, i.e. if the contact-breaking location 17 is vacated, the contact-type switch 10 is no longer active in a switching sense.

In a displacement direction opposite to that of the direction 28, the previously described individual switching stations are achieved in the reverse order.

The present invention is of course. in no way restricted to the specific disclosure of the specification and drawings, but also encompasses any modifications within the scope of the appended claims.

What I claim is:

1. In a contact-type switch that includes a housing and, disposed in said housing, a plunger having a long-stroke configuration, whereby essentially immediately after a shifting out of an outer end position and in a direction that is essentially in the direction of a central axis of said housing, said plunger breaks at least one switch contact that is disposed in said housing, and whereby a specific displacement path or dead travel is carried out by said plunger between said outer end position thereof and the position where said at least one switch contact is broken, the improvement wherein:

both said plunger and a region of said housing where said plunger enters the same have sufficient tolerance therebetween an essentially corresponding polygonal cross-sectional configuration with at least five sides arranged such that only two adjacent sides of the plunger will contact the respective adjacent two sides of the housing under any atmospheric conditions, with said entry region of said housing forming a first guide means for said plunger without seizure or wedging therebetween.

2. A contact-type switch according to claim 1, in which said plunger and said entry region have a hexagonal cross-sectional configuration.

3. A contact-type switch according to claim 1, in which said plunger is essentially hollow to form an interior; and which includes a switch contact mechanism in the form of an insert that is disposed in said interior of said plunger.

4. A contact-type switch according to claim 3, in which said switch contact mechanism is provided with at least one arm-like switch contact, which extends essentially parallel to said central axis of said housing.

5. A contact-type switch according to claim 4, in which said switch contact mechanism comprises a flat base portion from which extends at an essentially right angle at least one arm, at a free end of which, and as an extension thereof, is provided said switch contact.

6. A contact-type switch according to claim 4, in which said switch contact mechanism has an essentially at least five-sided cross-sectional configuration.

7. A contact-type switch according to claim 4, in which said plunger has a side wall that is provided with at least one radial opening through which a nose of said at least one switch contact can extend, with the number of said radial openings corresponding to the number of said switch contacts.

8. A contact-type switch according to claim 4, which includes a first projection that projects from a base of said interior of said plunger and essentially extends in the direction of a central axis of said plunger, with said first projection being provided for receiving and guiding a compression spring.

9. A contact-type switch according to claim 8, in which an end of said housing remote from said entry region thereof is closed off by a base part.

10. A contact-type switch according to claim 9, which includes a second projection that projects from an inner base surface of said base part and essentially extends in the direction of said central axis of said plunger, with said second projection also being provided for receiving an guiding said compression spring.

11. A contact-type switch according to claim 10, in which said base part is connected to said housing via snap means that are integral with at least one of said base part and said housing.

12. A contact-type switch according to claim 4, in which an end of said plunger is disposed in said housing and is provided with a second, wider guide means that is in sliding engagement with an interior housing wall that is at least partially embodied as a guide.

13. A contact-type switch according to claim 12, in which said interior housing wall has an essentially rectangular cross-sectional configuration.

14. A contact-type switch according to claim 4, which includes at least one contact strip that is disposed in said housing and extends essentially parallel to said central axis of said housing, with said contact strip cooperating with said at least one switch contact of said switch contact mechanism of said plunger.

15. A contact-type switch according to claim 14, in which said contact strip is provided with an active region that corresponds in length to said specific displacement path or dead travel; directly adjoining said active region, when viewed in a direction of displacement of said plunger into said housing, is an offset region of said contact strip that is inclined radially outward relative to said central axis of said housing.

16. A contact-type switch according to claim 15, in which said contact strip is integral with a contact plug means that leads beyond said housing

* * * * *